US005285972A

United States Patent [19]

Notebaart et al.

[11] Patent Number: 5,285,972

[45] Date of Patent: Feb. 15, 1994

[54] ORE PROCESSING

[75] Inventors: Cornelius W. Notebaart; Hendricus J. J. J. Megens; Irinaeus B. Klymowsky, all of Arnhem, Netherlands

[73] Assignee: Shell Research Limited, London, United Kingdom

[21] Appl. No.: 921,031

[22] Filed: Jul. 28, 1992

[30] Foreign Application Priority Data

Jul. 29, 1991 [GB] United Kingdom ..... 9116305.5

[51] Int. Cl.[5] ..... B03D 1/02; B03B 7/00; B03B 1/04

[52] U.S. Cl. ..... 241/19; 209/5; 209/166; 209/164; 209/17; 241/20; 241/24; 241/78

[58] Field of Search ..... 209/5, 164, 166, 167, 209/901, 17; 241/20, 24, 76, 78, 79.1, 19

[56] References Cited

U.S. PATENT DOCUMENTS

| | | | |
|---|---|---|---|
| 763,259 | 6/1904 | Cattermole | 209/5 |
| 787,814 | 4/1905 | Wolf | 209/166 |
| 809,959 | 1/1906 | Kirly | 209/166 |
| 835,120 | 11/1906 | Sulman | 209/166 |
| 1,022,085 | 4/1912 | Hyde | 209/166 |
| 1,452,662 | 4/1923 | Smith | 209/5 |
| 1,467,354 | 9/1923 | Christensen | 209/167 |
| 2,120,217 | 6/1938 | Harris | 209/166 |
| 3,268,071 | 8/1966 | Puddington | 209/5 |
| 4,214,710 | 7/1980 | Wilson | 209/166 |
| 4,253,614 | 3/1981 | McGarry | 209/5 |

FOREIGN PATENT DOCUMENTS

| | | | |
|---|---|---|---|
| 592684 | 2/1960 | Canada | 209/166 |
| 4259 | 11/1984 | PCT Int'l Appl. | 209/5 |
| 2791 | 7/1985 | PCT Int'l Appl. | 209/5 |
| 12778 | 6/1903 | United Kingdom | 209/166 |
| 16141 | 7/1914 | United Kingdom | 209/167 |
| 204495 | 10/1923 | United Kingdom | 209/167 |

*Primary Examiner*—Thomas M. Lithgow

[57] ABSTRACT

An improved process for the mechanical separation of complex, intergrown ores containing mineral of at least one of lead or zinc comprises a differential flotation process followed by an agglomeration process. The improved separation process is useful for bulk separation of mixed, intergrown minerals or for separation of one mineral from another, e.g., separation of lead-containing mineral from zinc-containing mineral.

8 Claims, 2 Drawing Sheets

FIG. 2
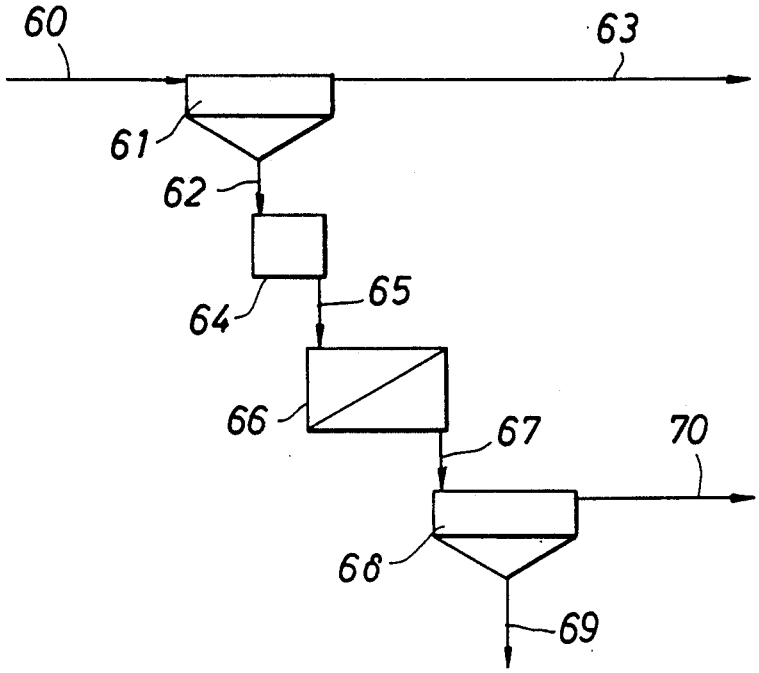
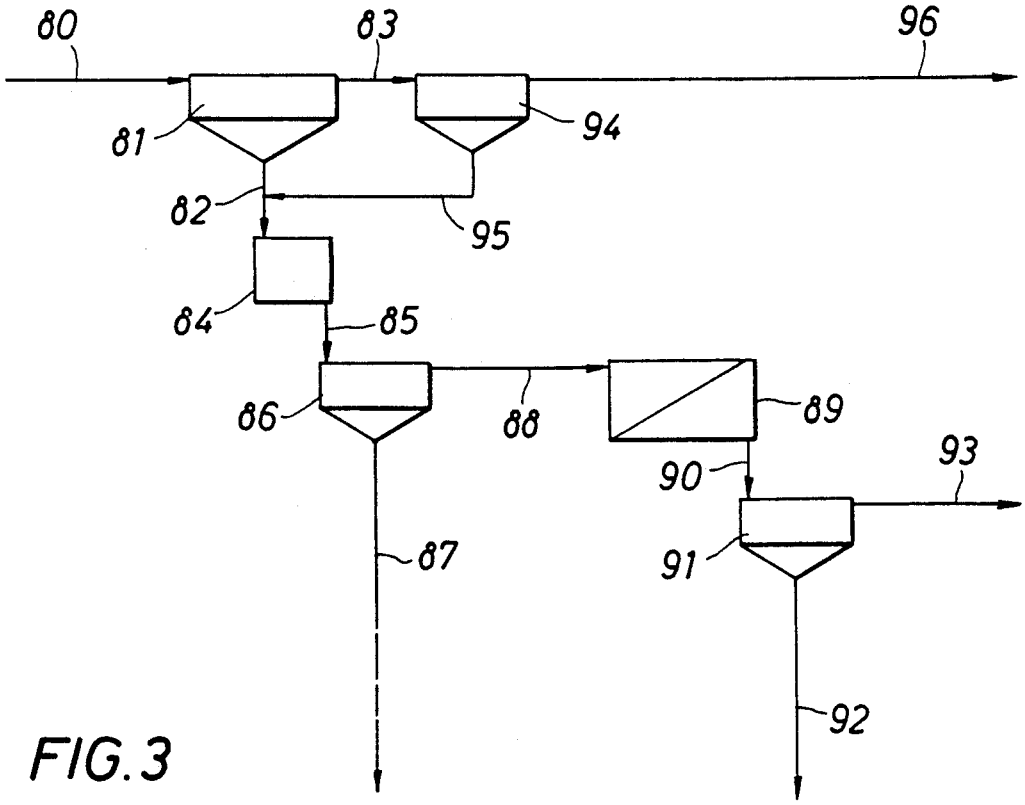
FIG. 3

ORE PROCESSING

FIELD OF THE INVENTION

This invention relates to a process of separating mineral materials containing at least one of lead and zinc from the gangue with which such mineral materials are associated in naturally occurring ore materials. More particularly, the invention relates to the separation of such complex, intergrown ore materials.

BACKGROUND OF THE INVENTION

Most minerals occur in nature as mixtures with other minerals as well as valueless materials commonly referred to as gangue. To obtain mineral materials, from which metals can be recovered, it is necessary to separate the mineral materials of the ore material from each other as well as from the gangue. This separation becomes particularly difficult if the ore material is complex as to the mineral structure and the mineral particles are intergrown. Mineral separations are characterized conventionally in terms of "recovery" and "grade" or "product grade". Recovery is the quantity of metal contained in any particular separation product or concentrate expressed as a percentage, often a molar percentage, of that metal contained in the feed, and grade or product grade is the content of a particular mineral or metal in that separation product expressed in terms of the total mass of that product. The effectiveness of a separation is determined by both recovery and grade which must properly be considered together, since the recovery is often inversely proportional to the grade.

The ores which comprise the primary sources of lead and zinc contain these elements in the form of metal sulfides, particularly as galena (PbS) and sphalerite (ZnS). These minerals often occur in an ore in varying proportions and are typically found in association with copper sulfides such as chalcopyrite ($CuFeS_2$) and pyrite ($FeS_2$). The conventional method of separation these minerals is by flotation, in particular froth flotation. The ore material is ground, usually by wet grinding, to liberate particles of mineral materials from the gangue materials. The mineral particles are then conventionally conditioned by treatment with collectors, i.e., additives optionally employed with an activator, which are designed to make the desired mineral material particles more hydrophobic, or depressants, i.e., additives designed to make the gangue or other minerals more hydrophilic. The minerals are suspended in an aqueous liquid termed "pulp" and dispersed air is then introduced into the mineral pulp in a stirred tank. The hydrophobic particles become attached to the air bubbles and are carried upwards to be collected in the froth which overflows the tank into a collector. The hydrophilic materials termed "tailings" leave the tank at a location away from the froth discharge and are collected for further processing or are discarded.

For an ore containing lead and zinc as well as copper and iron (as pyrite), a typical sequence is copper flotation, lead flotation, zinc flotation and finally pyrite flotation. Although only a portion of this overall sequence is typically applied to any given ore, there are established separate flotation lines for each mineral and the process is termed differential flotation. Often however, particularly high degrees of separation are difficult to obtain by flotation and mixtures of minerals are floated together in bulk flotation. This bulk flotation is particularly useful when the ore is complex and the minerals are intergrown. The product of a bulk flotation, a primary flotation concentrate, must be further processed, often by further flotation, after cleaning operations to improve the mineral grade by rejection of materials undesirably included within the flotation froth by, for example, mechanical entrainment or intergrowths. In this latter case, regrinding of particles is often required prior to cleaning. The tailings of such cleaner flotation cells are generally recycled to some earlier point in the overall process if the metal content of the tailings is such that the tailings cannot be discarded.

The separation of minerals by flotation is not entirely satisfactory. If the minerals are intricately intergrown, very fine grinding is required to liberate the mineral particles and separation of the resulting fine particles becomes difficult because of similar surface properties. As a result, a number of regrinding and reprocessing steps are required to effect the desired separation. In certain situations, the presence of a third mineral causes a desired separation of two minerals to become more difficult. The presence of cuprous sulfide, for example, may activate any pyrite present and lead to difficulty in separating lead and zinc sulfides from that pyrite.

Alternatives to flotation have been proposed for the separation of ores including liquid-liquid extraction and agglomeration. In the case of complex lead and zinc ores, no acceptable extractive separation has been achieved. While bulk separation is possible, the results obtained are not generally better than those obtained through flotation.

Agglomeration methods involve pretreatment of the minerals by methods similar to the pretreatment employed in flotation processes. The ore is ground and slurried in a stirred tank to establish density differences. Various reagents including depressants, activators and collectors are used to condition the particles as reviewed by Bulatovic et al, "Complex Sulfides," proceedings of a Symposium by AIME, San Diego, Calif., 1985. Reagents used for spherical agglomeration are not necessarily the preferred reagents of a flotation process. The ore particles rendered hydrophobic are conventionally agglomerated with a hydrocarbon liquid under conditions of shear in one or more stages in agitated tanks. The various stages often provide for initial agglomeration and also for agglomerate growth. The agglomerates are then separated by conventional mechanical methods such as screening, hydroclassification, flotation or other physical separation procedures.

Spherical agglomeration of copper-lead-zinc-containing mixtures has been evaluated by House et al, Min. Eng., 2 (2), pp. 171–184 (1989). However, the materials separated were artificial mixtures of chalcopyrite, sphalerite, pyrite and sand (quartz). Separation of such mixtures of these individual materials by agglomeration methods gave good results, but no evaluation of the method on complex, intergrown ores were disclosed. It was suggested, however, that agglomeration processes could be competitive with froth flotation for rough-ground mineral ores if further regrinding and agglomeration stages were used.

Spherical agglomeration separation does not, however, appear to be effective for intergrown particles in which one of the components is a relatively more hydrophobic mineral of relatively coarse particle size. Recovery is efficient only for any liberated material present. The coarse material could be reground, however, for further separation. It would be of advantage to have a simplified processing scheme for the separation of complex, intergrown ore material containing lead and zinc minerals which scheme reduces the number of steps including recycle steps required for separation of the minerals.

SUMMARY OF THE INVENTION

The process of the invention provides an improved process for the separation of complex ore material containing minerals including at least one of lead mineral or zinc mineral. The process includes (a) a grinding step to liberate to a degree effective for separation at least one mineral present from the gangue associated therewith; (b) a flotation conditioning step for the ground ore to obtain suitable flotation conditions for at least one mineral; (c) a flotation separation step for the conditional ground ore which provides a flotation concentrate stream and a flotation tailings stream, at least one of which streams contains a mineral sufficiently concentrated to permit effective mineral recovery; (d) a regrinding step for the flotation concentrate stream obtained from the flotation step sufficient to liberate at least one mineral contained therein from the gangue also present; (e) an agglomeration conditioning step for conditioning the reground material to permit agglomeration of liberated mineral; (f) at least one agglomeration step to produce agglomerates of liberated mineral; and (g) a separation step to obtain an agglomeration tailings stream comprising gangue minerals and an agglomerates stream of at least one mineral. The process obtains at least one mineral in high grade and high recovery while replacing a number of cleaner tailings operations as practiced in conventional flotation separations with one agglomeration step. The process provides for the efficient recovery in high grade of at least one mineral of lead mineral or zinc mineral from a complex, intergrown ore.

DESCRIPTION OF THE DRAWINGS

FIG. 2 shows a processing scheme for bulk flotation-agglomeration of metal-containing minerals in accordance with the invention, for example, differential bulk lead-zinc flotation. agglomeration.

FIG. 3 provides a processing scheme according to the invention for bulk flotation of at least two metal-containing minerals followed by differential flotation-agglomeration of the minerals.

DESCRIPTION OF THE INVENTION

The process of the invention broadly relates to the separation of minerals from a complex, intergrown ore. More particularly, the separation process of the invention is applied to complex sulfide ores including one or more minerals containing at least one of zinc and lead and optionally copper and iron. The process includes a regrinding step to liberate the materials to be separated from the gangue included in the ore. An initial flotation process provides at least a bulk separation of desired minerals. An agglomeration step follows, which replaces the frequently complex, multi-step separations of the more conventional flotation process. The overall process of the invention results in a high recovery in good grade of at least one of the lead or zinc minerals of the ore undergoing separation. The process typically provides at least one mineral in a high grade of at least 75 molar percent and in a high recovery of at least 50%.

DETAILED DESCRIPTION OF THE PREFERRED EMBODIMENT

The invention is further described by reference to the accompanying Figures.

Figure 1A:
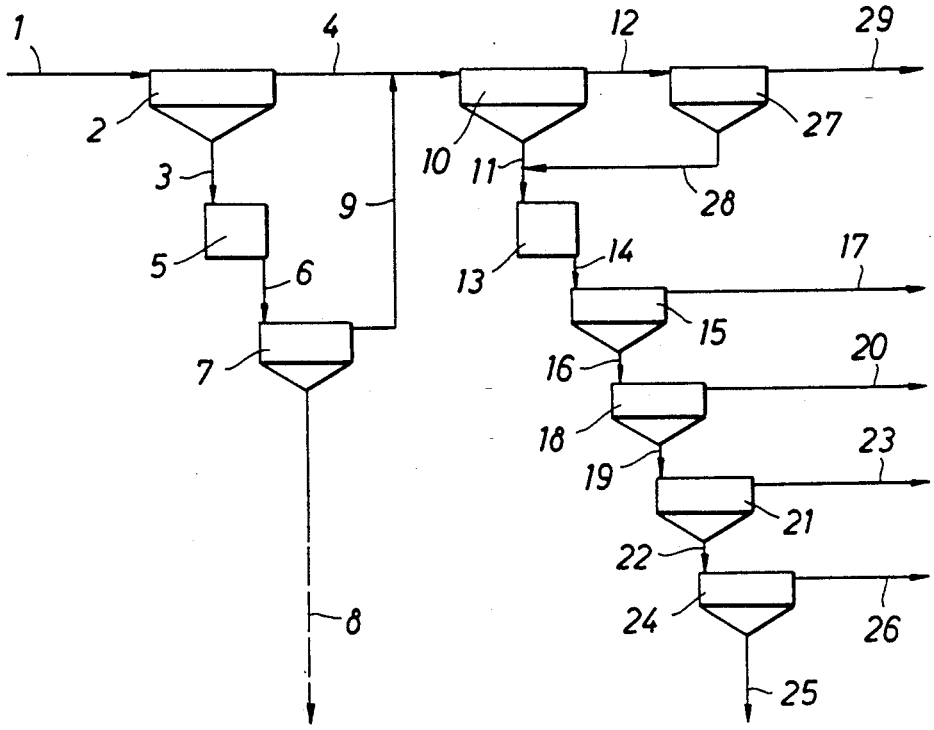
FIG. 1A (PRIOR ART)
FIG. 1A depicts a conventional prior art processing scheme for differential flotation of lead-zinc-containing minerals.

FIG. 1A depicts a conventional, prior art scheme for the separation of a complex ore containing, for example, galena and sphalerite, by differential flotation. In FIG. 1A, two parallel recovery lines are shown for concentrating lead and zinc, respectively. A feed stream 1 containing galena, sphalerite and gangue is supplied to a lead rougher flotation unit 2. Suitable flotation conditions for floating the lead-containing mineral, e.g., the galena particles, are introduced into the unit 2, thereby producing a first lead concentrate stream 3 and a first tailings stream 4 which consists primarily of zinc-containing mineral (sphalerite) and gangue. The first lead concentrate stream 3 is supplied to a regrinding unit 5 to liberate additional lead-mineral particles which were intergrown with particles of gangue and sphalerite. The reground stream 6 passes to a second flotation unit 7 from which a second lead concentrate stream 8 and a second tailings stream 9 are obtained. The lead concentrate stream provides lead mineral (galena) in suitable recovery. The second tailings stream 9 is combined with the first tailings stream 4 and is passed to the zinc recovery line of the process. The combined stream enters a zinc rougher flotation unit 10 after being conditioned by conventional methods for flotation of sphalerite particles. From the flotation unit 10 is obtained a tailings stream 12 which passes to a zinc scavenger unit 27. A scavenger tailings stream 29 essentially comprising gangue is obtained from this scavenger unit 27 by flotation and the zinc-containing concentrate from the scavenger unit 27 is removed as stream 28 and combined with the concentrate stream from the first flotation unit 10 as zinc concentrate stream The combined stream 11 is supplied to a regrinding unit 13 and the resulting reground stream is passed to subsequent cleaner units 15, 18, 21 and 24 to sequentially further increase the grade in the zinc cleaner concentrate streams 16, 19, 22 and 25. From each cleaner unit, a tailings stream, respectively lines 17, 20, 23, and 26, is obtained.

Figure 1B:
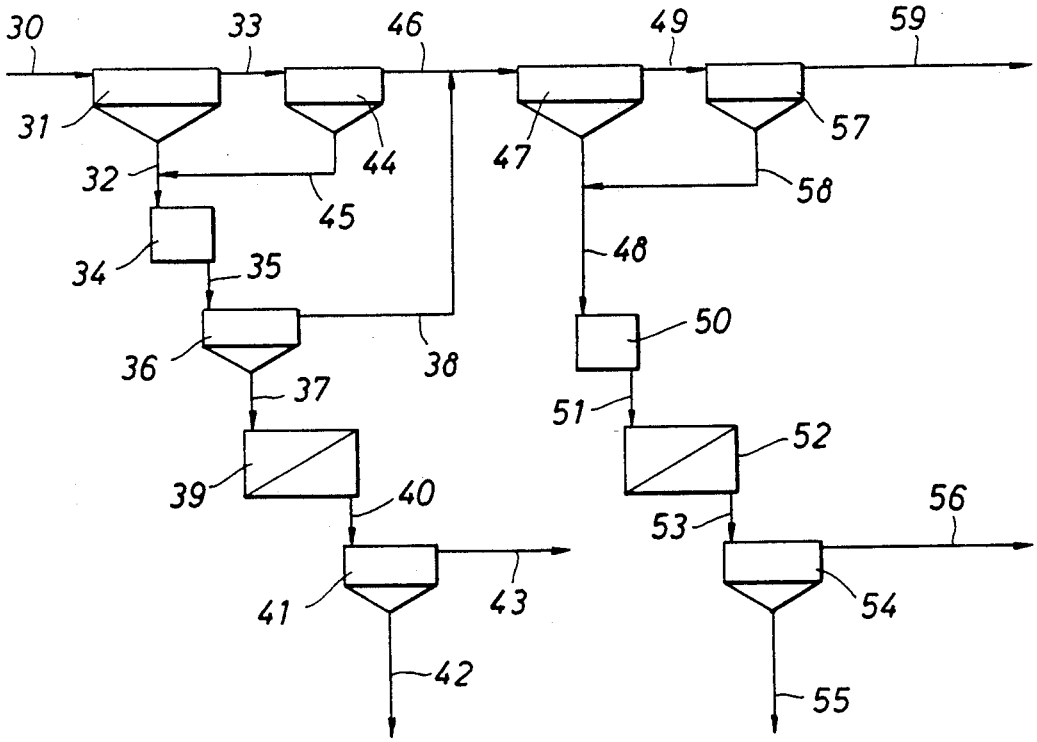
FIG. 1B describes a process for differential flotation-agglomeration of these minerals according to the invention.

In FIG. 1B, the same mineral ore is processed according to the invention. A feed stream 30, a lead-rougher flotation unit 31, a lead concentrate stream 32, a tailings stream 33, a regrinding unit 36, a cleaner tailings stream 38 and a cleaner concentrate stream 37 are shown for the lead recovery line as well as a lead scavenger unit 44 which is fed with tailings stream 33 to provide a lead scavenger concentrate stream 45, which is combined with lead concentrate stream 32, and a tailings stream 46 which is passed to the zinc recovery line. The zinc recovery line includes a feed stream 46 (tailings from the lead recovery line), a zinc-rougher flotation unit 47, a zinc concentrate stream 48, a tailings stream 49, a regrinding unit 50, a reground stream 51, a scavenger unit 57, a scavenger concentrate stream 58 which is combined with zinc concentrate stream 48, and a tailings stream 59.

According to the invention, the lead concentrate stream 37 and the zinc concentrate stream 51, after having been conditioned to be agglomerated by conventional methods, are passed to agglomeration units 39 and 52 respectively. Streams 40 and 53, containing concentrated agglomerates of galena and sphalerite, respectively, are passed to separation units 41 and 54 to obtain agglomerate stream 42 containing agglomerated galena, agglomerate stream 55 containing agglomerated sphalerite, and tailings streams 43 and 56 containing gangue particles to be discarded.

While the recoveries and grades of the two schemes of FIGS. 1A and 1B are comparable, the process scheme of FIG. 1B is less complex and permits simplified process control. Thus, more effective processing is obtained.

FIG. 2 depicts a process in accordance with the invention for a bulk flotation-agglomeration processing scheme. The scheme includes a feed line 60 which, after being conditioned for flotation by conventional methods, is supplied to a bulk lead-zinc concentrate stream 62 and a tailings stream 63. In this flotation, a major part of intergrown ores such as galena and sphalerite is separated from gangue material to obtain a bulk recovery of lead. zinc-containing minerals. To liberate additional mineral, the concentrate stream 62 is passed to a regrinding unit 64 to provide a reground stream 65. This reground stream, after being conventionally conditioned for agglomeration, is sent to an agglomeration unit 66. An agglomerate-containing stream 67 containing predominantly galena and sphalerite is supplied to a screening unit 68 from which is obtained an agglomerates tailings stream 70 and an agglomerates stream 69. The agglomerates stream provides combined galena and sphalerite in good grades and recoveries.

In FIG. 3, a somewhat different embodiment of the process of the invention is shown. A complex copper-zinc-lead-iron ore comprising chalcopyrite, sphalerite, some galena and pyrite is subjected to the process. Conventional differential flotation of this mixture proved non-feasible, possibly due to activation of the galena and sphalerite by copper ions derived from the chalcopyrite.

In the process of FIG. 3, a feed stream 80 of ore material ground and conditioned for flotation is sent to a copper-lead-zinc rougher flotation unit 81 from which is obtained a flotation concentrate stream 82 and a flotation tailings stream 83. The flotation tailings stream 83 is sent to a scavenger unit 94 from which is obtained a scavenger tailings stream 96 and a scavenger concentrate stream 95 which is combined with the flotation concentrate stream 82. The combined concentrate stream is passed to a regrinding unit 84. The reground stream 85 from the regrinder unit 84 is further processed in a cleaner unit 86 to provide a cleaner concentrate stream 87 and a cleaner tailings stream 88. The cleaner concentrate stream 87 contains mainly chalcopyrite. The cleaner tailings stream primarily contains the sphalerite and pyrite.

The cleaner tailings stream 88 is sent to a second agglomeration unit 89 from which a second agglomerates stream passes as stream 90 to a second separation unit 91. The second separation unit tailings are primarily pyrite whereas the second agglomerates stream provide zinc mineral in high grade and recovery.

The invention is further illustrated by the following Illustrative Embodiments, including comparative experiments, which should not be regarded as limiting. In each Illustrative Embodiment, the processes evaluated and the results obtained are described in terms of FIGS. 1-3 wherein the reference numbers correspond to the identifying numbers of each Figure as more fully described above.

ILLUSTRATIVE EMBODIMENT I

A mineral ore, comprising very intricately intergrown galena-sphalerite mineral originating from the McArthur River deposit of Australia, is processed by the scheme of FIG. 1A and also by the scheme of FIG. 1B. In each of the Figures, the left portion is a bulk lead-zinc processing line and the right portion is a processing line for the recovery of zinc. The ore material, prior to separation, was ground until 80% of the ore particles were smaller than 20 μm. The results are shown in Table I.

TABLE I

| FIG. Ref. No. | | | Grade (% m/m) | | Recovery (%) | |
|---|---|---|---|---|---|---|
| 1A | 1B | Product | Zn | Pb | Zn | Pb |
| 8 | — | Pb cleaner concentrate | 30.7 | 31.8 | 5.9 | 16.7 |
| 25 | — | Zn cleaner concentrate | 52.0 | 10.0 | 59.7 | 31.6 |
| 17 | — | Zn cleaner 1 tailings | 7.7 | 5.8 | 3.8 | 7.9 |
| 20 | — | Zn cleaner 2 tailings | 22.0 | 9.4 | 10.1 | 11.9 |
| 23 | — | Zn cleaner 3 tailings | 27.5 | 10.2 | 5.6 | 5.8 |
| 26 | — | Zn cleaner 4 tailings | 37.9 | 11.2 | 5.9 | 4.8 |
| 29 | — | final tailings | 3.6 | 3.1 | 9.0 | 21.3 |
| 1 | — | feed | 19.4 | 7.1 | 100.0 | 100.0 |
| — | 42 | Pb agglomerates | 36.8 | 25.4 | 23.3 | 44.5 |
| — | 43 | Pb agglomerate tailings | 7.1 | 6.7 | 1.1 | 3.0 |
| — | 55 | Zn agglomerates | 51.3 | 9.1 | 63.2 | 31.1 |
| — | 56 | Zn agglomerate tailings | 5.7 | 3.1 | 7.0 | 10.5 |
| — | 59 | final tailings | 2.9 | 2.1 | 5.4 | 10.9 |
| — | 30 | feed | 19.5 | 7.1 | 100.0 | 100.0 |

It should be noted that the grades and recovery of the two schemes are comparable. However, in the scheme of FIG. 1B, one agglomeration step replaced several cleaner tailings steps, thereby providing processing advantages.

ILLUSTRATIVE EMBODIMENT II

Ground mineral ore of the type employed in Illustrative Embodiment I was subjected to the bulk processing scheme of FIG. 2. The processing results are shown in Table II.

TABLE II

| Reference | | Grade (% m/m) | | Recovery (%) | |
|---|---|---|---|---|---|
| No. | Product | Zn | Pb | Zn | Pb |
| 69 | Agglomerates | 46.3 | 13.2 | 78.2 | 37.0 |
| 70 | Agglomerate tailings | 3.3 | 5.0 | 12.0 | 30.3 |
| 63 | Final tailings | 1.3 | 2.5 | 9.8 | 32.7 |
| 60 | feed | 7.8 | 4.7 | 100.0 | 100.0 |

ILLUSTRATIVE EMBODIMENT III

A mineral ore material, ground until 80% of the ore particles were smaller than 20 μm, was processed according to the scheme of FIG. 3. The ore was a complex intergrown ore mainly comprising chalcopyrite, sphalerite and pyrite. The results are shown in Table III and compared with conventional flotation processing (CFP) of the same ore.

TABLE III

| CFP | FIG. 3 | Product | Grade (% m/m) Zn | Pb | Air | Recovery (%) Zn | Pb | Air |
|---|---|---|---|---|---|---|---|---|
| | — | Air cleaner concentrate | 3.1 | 1.5 | 23.0 | 31.1 | 64.0 | 83.7 |
| | — | Air final tailings | 0.1 | 0.1 | 0.2 | 3.0 | 19.3 | 4.2 |
| | — | Zn cleaner concentrate | 14.9 | 0.2 | 3.1 | 54.8 | 3.8 | 4.1 |
| | — | Zn cleaner 1 tailings | 1.0 | 0.2 | 1.4 | 2.9 | 2.5 | 1.7 |
| | — | Zn cleaner 2 tailings | 1.2 | 0.2 | 1.7 | 1.7 | 1.2 | 0.8 |
| | — | Zn cleaner 3 tailings | 1.8 | 0.2 | 2.2 | 1.6 | 0.8 | 0.7 |
| | — | Zn final tailings | 0.3 | 0.1 | 0.7 | 4.8 | 8.3 | 4.7 |
| | — | feed | 1.1 | 0.3 | 3.2 | 100.0 | 100.0 | 100.0 |
| — | 87 | Air cleaner concentrate | 1.7 | 1.8 | 26.5 | 13.3 | 58.4 | 80.3 |
| — | 96 | Air final tailings | 0.1 | 0.1 | 0.4 | 7.8 | 29.6 | 11.6 |
| — | 92 | Zn agglomerates | 47.0 | 0.3 | 3.0 | 59.0 | 1.6 | 1.5 |
| — | 93 | Zn agglomerate tailings | 1.5 | 0.2 | 1.3 | 19.9 | 10.4 | 6.7 |
| — | 80 | feed | 1.1 | 0.3 | 2.8 | 100.0 | 100.0 | 100.0 |

In the above Table III, the values for copper concentration are comparable, but the zinc concentration in an increased grade is substantially higher (47.0% vs. 14.9% m/n) for the process of the invention illustrated by FIG. 3.

What is claimed is:

1. A process for the separation of a complex ore material comprising gangue and minerals including at least one of lead mineral or zinc mineral, which process comprises (a) grinding the ore to an extent effective to liberate at least one of said lead or zinc minerals from the gangue material of the ore;

(b) conditioning the ground ore by treatment with collector or depressant to obtain flotation conditions for at least one of said lead or zinc minerals;

(c) subjecting the ground and conditioned ore to flotation to obtain a flotation concentrate stream and a flotation tailings stream, at least one of which streams contains at least one of said lead or zinc minerals sufficiently concentrated to permit effective mineral recovery;

(d) regrinding the flotation concentrate stream to a degree effective for liberating at least one said at least one of said lead or zinc minerals contained therein from the gangue material present;

(e) conditioning the reground material by treatment with an agglomerating reagent to obtain agglomeration conditions for the at least one of said lead or zinc materials of the reground material;

(f) agglomerating at least once the reground, conditioned material to produce an agglomerates stream containing at least one of said lead or zinc materials, and an agglomerates tailings stream; and (g) separating the agglomerates stream containing at least one of said lead or zinc minerals and the agglomerates tailings stream;

the process separating at least one of said lead or zinc minerals from the complex ore in high grade and recovery.

2. The process of claim 1 wherein the flotation is a bulk flotation.

3. The process of claim I wherein the flotation is a differential flotation.

4. The process of claim 3 wherein the flotation tailings stream is further subjected to steps (b)-(g).

5. The process of claim 4 wherein the complex ore is a complex sulfide ore.

6. The process of claim 5 wherein the ore comprises lead mineral and zinc mineral.

7. The process of claim 6 wherein the flotation tailings stream is further subjected to steps (b)-(g), thereby obtaining separation of one mineral as the agglomerates stream obtained from the flotation concentrates stream and one mineral as the agglomerates stream obtained from the flotation tailings stream.

8. The process of claim 7 wherein the mineral obtained from the flotation concentrate stream is a lead mineral and the mineral obtained from the flotation tailings stream is a zinc mineral.

* * * * *